US009527634B2

(12) United States Patent
Stryker et al.

(10) Patent No.: US 9,527,634 B2
(45) Date of Patent: Dec. 27, 2016

(54) DISPENSING PAINT CAN LID AND STAND COMBINATION

(71) Applicants: Doug Stryker, Flemington, NJ (US); Lonnie Lauer, Clinton, NJ (US)

(72) Inventors: Doug Stryker, Flemington, NJ (US); Lonnie Lauer, Clinton, NJ (US)

( * ) Notice: Subject to any disclaimer, the term of this patent is extended or adjusted under 35 U.S.C. 154(b) by 0 days.

(21) Appl. No.: 14/298,438

(22) Filed: Jun. 6, 2014

(65) Prior Publication Data

US 2015/0353243 A1 Dec. 10, 2015

(51) Int. Cl.
*B65D 47/06* (2006.01)
*B44D 3/12* (2006.01)
*B67D 3/00* (2006.01)

(52) U.S. Cl.
CPC ..... *B65D 47/06* (2013.01); *B44D 3/127* (2013.01); *B67D 3/0035* (2013.01)

(58) Field of Classification Search
CPC ..... B65D 47/06; B65D 43/0204; B65D 25/24; B44D 3/127; B44D 3/08; B67D 3/0035; B67D 3/0032; B67D 3/0029
See application file for complete search history.

(56) References Cited

U.S. PATENT DOCUMENTS

| | | | | | |
|---|---|---|---|---|---|
| 1,740,384 | A * | 12/1929 | Wright | B67D 3/0029 | 141/300 |
| 3,777,941 | A * | 12/1973 | Riddle | B65D 47/00 | 222/207 |
| 4,034,901 | A | 7/1977 | Kirk | | |
| 4,505,408 | A * | 3/1985 | Sagol | 222/185.1 | |
| 4,516,697 | A * | 5/1985 | Dreps et al. | 222/212 | |
| 4,646,944 | A * | 3/1987 | Sanderson | 222/108 | |
| 5,460,298 | A * | 10/1995 | DiBiase et al. | 222/173 | |
| 6,578,802 | B1 * | 6/2003 | Thier | 248/151 | |
| 6,715,647 | B1 * | 4/2004 | Ivins | 222/166 | |
| 6,892,903 | B1 * | 5/2005 | Bartolotta | 222/185.1 | |
| 8,087,547 | B1 * | 1/2012 | Lindsey | 222/184 | |
| 2001/0023877 | A1 * | 9/2001 | Walters | 222/185.1 | |
| 2004/0069808 | A1 * | 4/2004 | Blain | 222/185.1 | |
| 2006/0283883 | A1 * | 12/2006 | Mika et al. | 222/129 | |

* cited by examiner

*Primary Examiner* — Frederick C Nicolas
*Assistant Examiner* — Bob Zadeh
(74) *Attorney, Agent, or Firm* — Thedford I. Hitaffer; Hitaffer & Hitaffer, PLLC

(57) ABSTRACT

A lid has a support extending therefrom for maintaining a container in an inverted position. The lid further comprises a dispenser, such that when the lid is connected to a container and the container is inverted, gravity compels contents of the container out the dispenser.

14 Claims, 4 Drawing Sheets

DISPENSING PAINT CAN LID AND STAND COMBINATION

I. BACKGROUND

A. Field of Invention

The present invention generally relates to dispensers. Particularly, the present invention relates to lid dispensers for containers that can include a stand. Even more particularly, dispensed material is flowable, such as paint.

B. Description of the Related Art

A lid is typically used to retain material in a container. In an example of a paint can, material contained is flowable paint. A paint can is typically available for purchase in a cylindrical container that has at least one opening covered by a lid. Some lids have a ridge formed about an interior side, i.e., underside, that provides means to secure it to a complimentary groove disposed about the upper edge or periphery of the paint can opening.

To dispense paint from a can, generally the lid must be pried by detaching the ridge from the groove, usually by a flat edge screw driver. Then the can is tilted so contents may be poured out into a paint tray, for example. When pouring, it is not unusual for paint to pass over the upper edge of the paint can opening. And, as a result, paint typically collects within the groove disposed about the upper edge, as well as along the exterior side of the can and usually dripping onto the ground. This result is not only messy, but causes waste and overall loss of the amount of useable paint.

Furthermore, it is not unknown for too much paint to be poured out due to an uncontrolled flow and or as a result of fatigue by a user, let alone spills caused by cans being toppled over. Additionally, if and or when the lid is reattached or resealed to the can, paint that collected within the groove is forced out by the ridge of the lid, causing an undesirable and uncontrollable splatter of paint.

Accordingly, there is a need in the industry for a dispending lid that can attach to a container, such as a paint can, that would allow a user to control the flow of contents dispensed therefrom, as well as reduce the amount of waste, all while minimizing fatigue and or effort of a user.

II. SUMMARY

The instant invention includes a lid that replaces an original lid on a container, wherein said container contains flowable material for example which may include paint, shellac, stain, and the like. The replacement lid subject to the instant invention can be universally sized and shaped to connect to the container in an airtight fashion to protect and hold material within the container. In an embodiment, the lid comprises means to connect to variable sized container and or container openings.

In an embodiment, for example when the container holds flowable material, for example, the corresponding replacement lid in accordance with the instant invention comprises a geometry that directs said material beyond the lid in a controlled manner. In an embodiment, the internal geometry of the replacement lid may comprise a funnel-like or sloping geometry that communicates with a spout, tube and/or conduit. The flow rate of material directed thereto may be regulated by a control valve.

In an embodiment, the lid comprises support means that maintain the container in an inverted position, when the lid is attached thereto. In this arrangement, gravity acts as a force to direct material out from the container and through the lid. In an embodiment, support means extend out from a surface of the lid. Said support means may include legs fashioned like a tripod, which can be individually adjusted by extension and retraction. It is an embodiment of the invention that the legs can also be segmented and hinged.

In a further embodiment of the invention, internal geometry of the lid is flat and the support means is manipulated, sized and/or shaped to direct flowable material out through the lid.

III. BRIEF DESCRIPTION OF THE DRAWINGS

The invention may take physical form in certain parts and arrangement of parts, some embodiments of which will be described in the specification and illustrated in accompanying drawings which form a part hereof, wherein, FIG. 1 is an embodiment of the invention showing an inverted container that is connected to a lid according to the instant invention. As shown, the lid has legs as support means which extends from the outer surface in a tri-pod fashion.

FIG. 2 is an embodiment of the instant invention providing how a conduit may be releaseably attached to the lid according to the invention.

FIG. 3 is a cut away view of an embodiment of the invention, wherein the internal geometry of the interior surface of the lid is concave or funnel-like. The lid has a ridge (connection means) that allow it to connect to a groove of a can. As shown, support means may be hinged and segmented. FIG. 3 further provides an additional embodiment of the instant invention, wherein the interior surface of the lid may accommodate a smaller sized container (the smaller container being shown in broken lines).

IV. DETAILED DESCRIPTION OF THE INVENTION

The instant invention is for a lid that comprises support means used to maintain a container in an inverted position. The lid further comprises a dispenser, such that when the lid is connected to a container and the container is inverted, gravity compels contents of the container out the dispenser.

Figure 1:
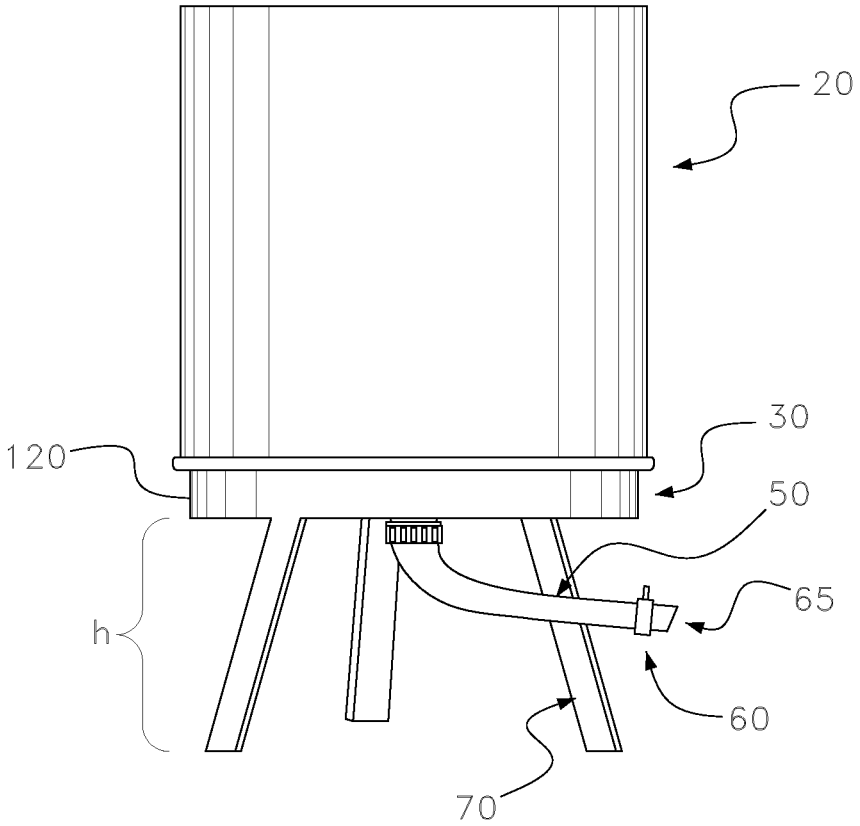

FIG. 1 provides an embodiment of the instant invention. As shown in FIG. 1, container 20 is inverted and connected to lid 30. Although not shown in the Figure (but shown in FIG. 3 for example, container 20 has a groove 45 disposed about the periphery of its opening which corresponds to a lids connection means such as a ridge 40 which may be disposed about the interior surface of lid 30—and to correspond to the groove. U.S. Pat. No. 4,034,901 (Kirk) discloses a Dripless Spout for Cans, and provides in FIG. 2 a cross section that shows this well-known connection, the disclosure of which is incorporated herein. Lid 30 may be formed of any materials not limited to metals and plastics, however it is preferred that the interior surface of lid 30, which comes into contact with contents of said container 20, be non-reactive and have a low coefficient of friction.

Figure 2:
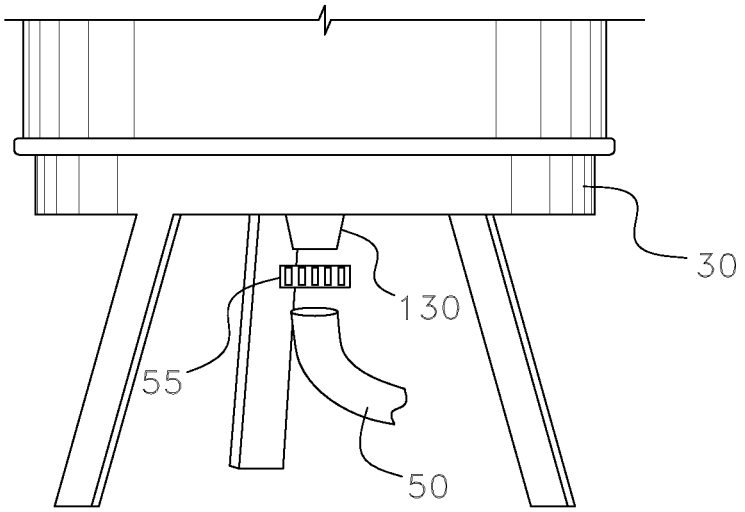

Extending from lid 30 is conduit 50. As shown, conduit 50 extends from the exterior surface of lid 30. The conduit 50 may be integrally formed to lid 30 or may be releaseably connected thereto, as shown in FIG. 2 (in order to facilitate cleaning and or replacement of a dirty or damaged conduit). As shown in FIG. 2, spout 130 extends from the exterior surface of lid 30. Conduit 50 is connected to said spout 130 by means 55 that may include temporary devices such as a clamp, clasp, or other known means that can releaseably secure conduit 50 to said spout 130. In an embodiment, means 55 allows conduit 50 to pivot and or rotate relative to spout 130. It is further an embodiment of the invention that lid 30 may be manufactured separately than the conduit 50, and bonded or assembled thereafter. Accordingly, it is within the scope of the invention that conduit 50 may connect to spout 130 by more permanent means, such as adhesive or solder, etc. In another embodiment, spout 130 may be akin to an integrally formed conduit 50, whereby a regulator is disposed about said spout to control the flow of material there through.

Conduit 50 comprises an opening 65 that directs flowable material such as paint into a paint tray 100 for example. The flow of material out opening 65, can be controlled by a regulator 60 disposed about conduit 50 as shown, and may include known means such as a spigot or control valve and may be used to start, stop, or regulate said flow.

Support means 70 extends from the exterior surface of lid 30 to a surface such as a floor (not shown). Said support means 70 are used to maintain lid 30 at a height, h, when in an inverted position, as shown. Typically, h, should maintain lid 30 a sufficient distance above a surface such that opening 65 can directly dispense into a paint tray 100 or like container for example. In the embodiment as shown in FIGS. 1-4 and 6, support means 70 consist of three (3) legs, arranged in a fashion much like a tripod. It is an embodiment of the invention that support means 70 may be integrally formed to lid 30, be releaseably attached or hingedly attached. In the embodiment as shown in FIG. 7, the support means 70 comprise three legs that are telescoping. The use of telescoping means is beneficial to retract the legs during storage and to compensate for uneven surfaces, for example. It is seen from FIG. 7 that the legs comprising support means 70 can be adjusted to different heights (e.g., compare $h_1$ to $h_2$ ). This characteristic not only accommodates uneven surfaces, but also is able to tilt the container 20. It is an embodiment of the invention however that at least one leg is telescoping in an embodiment as disclosed in FIG. 7, wherein the internal geometry of lid 30 is flat.

Figure 3:
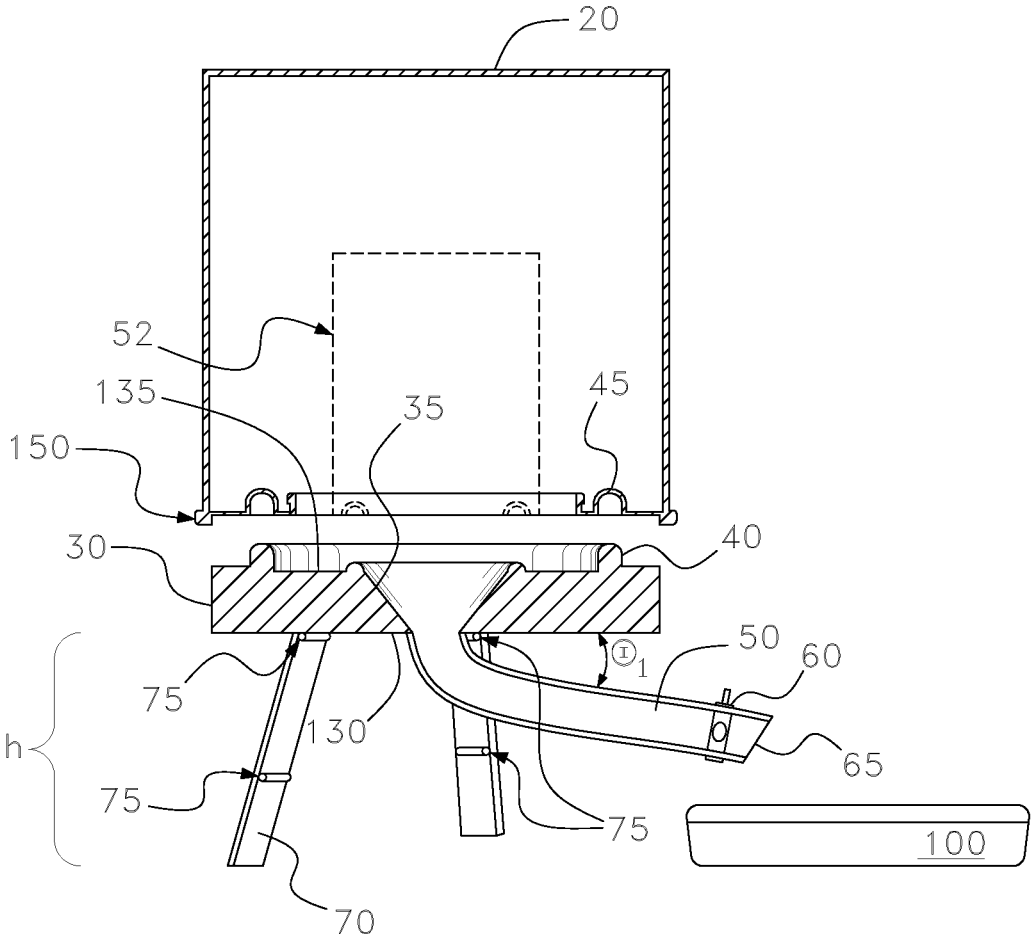

FIG. 3 is a cut away view of an embodiment of the invention. As shown (and incorporated by Kirk) ridge 40 is disposed about the interior surface of lid 30 and is sized and shaped to connect with groove 45 disposed about the periphery of the opening of container 20. As clearly seen in FIGS. 3 and 4, ridge 40 has cylindrical inner and outer walls, and projects along the cylindrical outer wall of container 20 when the latter is connected to lid 30. It should be noted that the connectivity between lid 30 and container 20 is like the connectivity of container 20 with its original lid. By this arrangement, flowable material, such as paint, is prevented from entering said groove 45.

Figure 4:
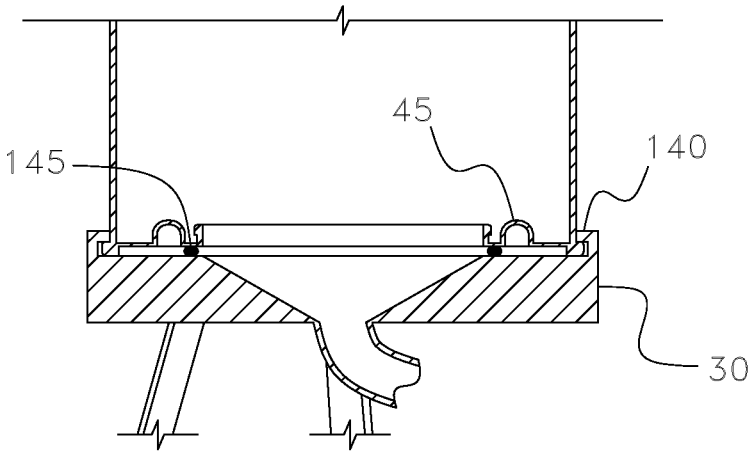
FIG. 4 is a cut away view of an embodiment of the invention wherein the lid comprises a notch that connects to an exterior lip of a container and further comprises a gasket disposed on its inner surface to prevent material from entering the groove about the opening of the container.

It is within the scope of the invention that a replacement lid comprise similar and or identical means as an original lid, in order to attach to a respective container, not limited to a paint can or container as disclosed herein. For example, it is well-known that many containers, may not have groove like container 20 disclosed herein, yet it may other connectivity means disposed. By way of the example of the container 20 presented herein, the container has a lip 150 that is disposed around the outside periphery of the opening of container 20. Accordingly, while it is an embodiment of the invention that ridge 40 is used to connect to said container 20 (and prevent flowable material, such as paint, from entering said groove 45), it is however also within the scope of the invention that lid 30 comprise means such as a notch 140 that is capable of connecting to lip 150 as shown in FIG. 4, whereby the notch is connecting means disposed about the side of the lid 30. Notch 140 opens inwardly toward the center of lid 30 to engage a lip of the container 20. In this embodiment, a gasket 145 is disposed about the inner surface of lid 30 to prevent flowable material from entering said groove 45. The gasket 145 may be a deformable material, such that when notch 140 engages with lip 150, a region between the opening of can 20 and groove 45 will press down on gasket 145 creating an impervious barrier. It should be understood that not all containers would have a groove, but should have means that allow it to connect to a lid or replacement lid, and further comprise a flat region to be capable of pressing down on gasket 145 to form such a barrier.

A further embodiment of lid 30 provides for additional ridge 35 concentrically formed about the inner surface of lid 30. The inner ridge is like ridge 40, but ridge 35 is designed to be able to accommodate containers that have a smaller sized opening as shown by a smaller container in broken lines.

As further shown in FIG. 3, lid 30 comprises an internal geometry that is concave or funnel-like to direct flowable material through conduit 50 when container 20 is inverted. Conduit 50 communicates with said funnel and extends from the surface of lid 30 at an angle θ1, which may be between about 10 degrees to about 90 degrees relative to the plane of lid 30 as shown, so that the force of gravity would compel the majority, if not all flowable material to exit opening 65. As stated, it is within the scope of the invention that conduit 50 may be integrally formed with lid 30 and comprise like materials which can be rigid and include materials such as plastic or metal. Furthermore, it is within the scope of the invention that conduit 50 may comprise pliable material, and or be releaseably connected, wherefore the direction of flow of materials out from opening 65 can be manipulated by merely stretching or bending conduit 50 for example. FIG. 3 additionally provides an embodiment of support means 70 wherein said support means 70 may comprise three (3) legs that can include a series of hinges 75 in order to allow for the legs to be bent and positioned out of place when lid 30 is not in use and or when it is being stored.

Figure 5:
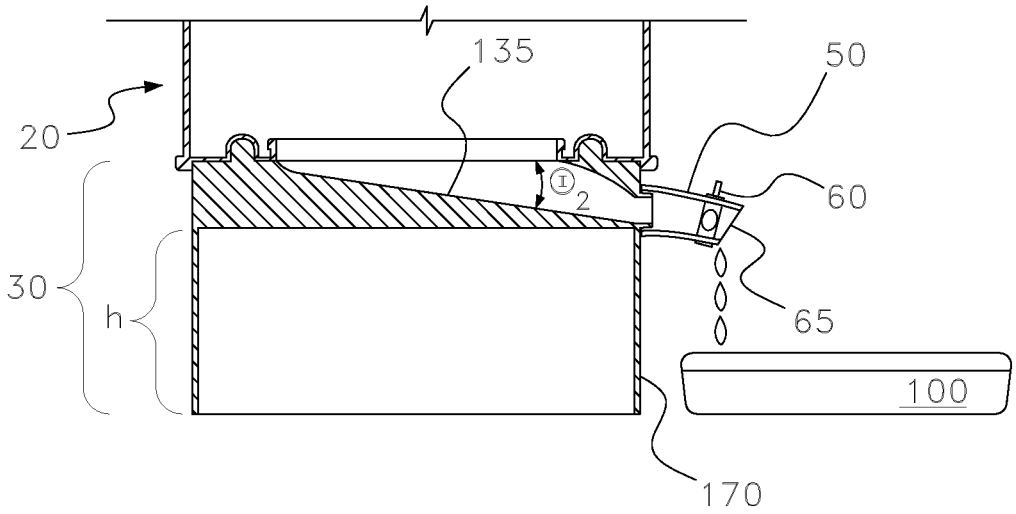
FIG. 5 is an embodiment of the invention providing a cut away to show the internal geometry of the interior surface of the lid, which is slanted and or at a slope, wherein a conduit extends from the exterior side of the lid.

FIG. 5 is a cross section of another embodiment of the instant invention whereby the interior surface of lid 30 comprises slope 135. As shown, flowable material is directed down slope 135 to conduit 50. In the embodiment, conduit 50 extends from the side 120 of lid 30, as opposed to the exterior surface as shown in FIGS. 1-4, for example. In this embodiment, the length of conduit 50 may be lessened, thereby reducing costs associated with production, among other benefits. The slope 135 can be at an angle $\theta_2$, which can be from at about 10 degrees to about 80 degrees, or less than about 45 degrees as shown.

As shown, support means 170 is an extension of lid 30. It is within the scope of the invention that support means 170 may be hollowed out or solid, so long as support means is capable of maintaining lid 30 at a height sufficient to allow flowable material, such as paint (indicated by droplets in the FIG. 5) to dispense into a paint tray 100 for example. It is further an embodiment of the invention that support means 170, alternatively comprise support means 70 as disclosed in FIG. 1, and consist of three (3) legs, arranged in a fashion much like a tripod. Which leads to the notion that support means shall be interchangeable in embodiments disclosed herein.

Figure 6:
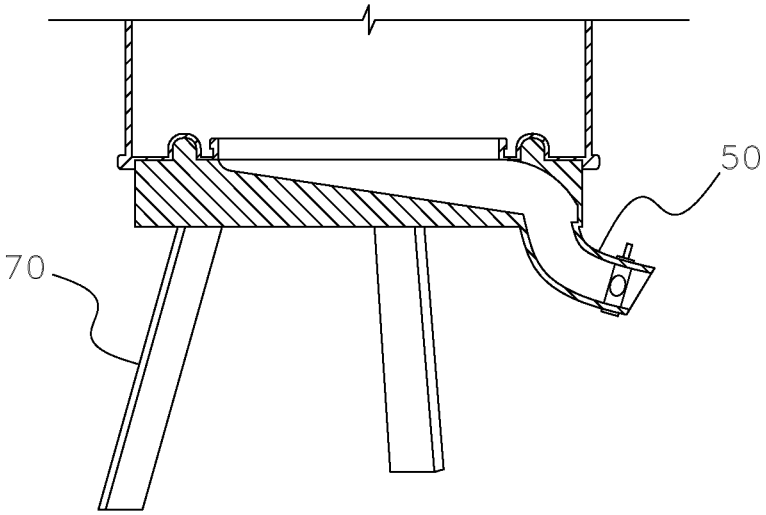
FIG. 6 is an embodiment of the invention providing a cut away to show the internal geometry of the interior surface of the lid, which is slanted and or at a slope, wherein a conduit is integrally formed and extends from the exterior surface of the lid.
Figure 7:
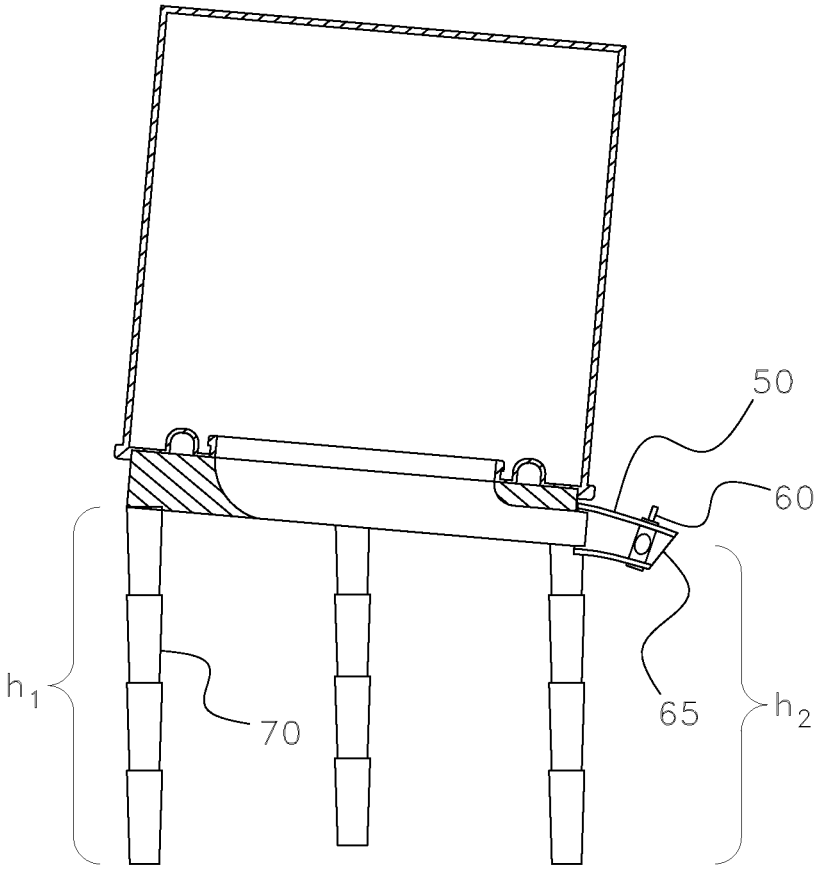
FIG. 7 is an embodiment of the invention wherein the internal geometry of the interior surface of the lid is flat, wherein the support means provides a tilt to the lid such that contents are directed therethrough.

FIG. 6 provides an embodiment of the invention wherein the internal geometry of lid 30 comprises a slope, similar to embodiment disclosed in FIG. 5 however, conduit 50 extends from the exterior surface of lid 30. As shown, support means 70 are fashioned like the disclosure in FIG. 1 for example. Because the Figure provides for a cut away, the third leg is not visible because it has been cut away as similar to FIGS. 3 and 4.

FIG. 7 shows an embodiment of the instant invention whereby the internal geometry of lid 30 is flat and conduit 50 extends from the side of lid 30. In order to provide an imbalance and or tilt to direct flow out of container 20 through conduit 50, support means 70 are manipulated. As shown, in FIG. 7, support means 70 comprises three (3) legs wherein at least one leg is telescoping so that it may be adjusted to provide an overall tilt to container 20 such that the imbalance directs contents to ultimately exit hole 65. It is within the scope of the invention that the ability for all legs to telescope may be advantageous in the instance where a user needs to adjust the overall height of lid 30. It is a further embodiment of the invention that all legs may telescope such that they may be more easily stored when not in use. In view of the several embodiments presented herein, various changes and modifications may be made without departing from the spirit and scope of the Invention. It is intended that such obvious changes and modifications be embraced by the annexed claims.

What is claimed is:

1. A dispensing paint can lid capable of connecting to a can containing a flowable material, whereby said lid comprises:

a connector structured to connect said lid to said paint can, said connector comprises at least a first ridge depending from an interior surface of said lid, wherein said first ridge has cylindrical inner and outer walls to engage corresponding cylindrical inner and outer walls of a groove of said can by press-fit when said lid is connected to said can, and a second ridge depending from said interior surface of said lid, wherein said second ridge is smaller than said first ridge, said second ridge being disposed within said first ridge, said second ridge having cylindrical inner and outer walls to engage corresponding cylindrical inner and outer walls of a smaller can when said lid is connected to said smaller can;

a conduit that extends from said lid; and a regulator capable of controlling the flowable material through said conduit.

2. The dispensing paint can lid of claim 1, further comprising a spout formed on said lid.

3. The dispensing paint can lid of claim 2, wherein said conduit is connected to said spout.

4. The dispensing paint can lid of claim 1, further comprising a support that maintains the lid at a height above a surface.

5. The dispensing paint can lid of claim 4, wherein the support comprises at least three legs that maintain the lid at the height above a surface, wherein at least one of said at least three legs can be adjusted to a different height than the other of said at least three legs to tilt said can.

6. The dispensing paint can lid according to claim 4 whereby said support member comprises at least three support legs.

7. The dispensing paint can lid according to claim 6, wherein said at least three support legs are releaseably connected to the lid.

8. The dispensing paint can lid according to claim 6, wherein at least one of said at least three support legs is telescoping to a different height than the other of said at least three support legs to tilt said can.

9. The dispensing paint can lid of claim 1 further comprising:

a spout extending from said lid; and a support member extending from said lid that is capable of maintaining said lid at a height above a surface, wherein said interior surface of said lid comprises a slope for directing the flowable material down said slope to said spout.

10. The dispensing paint can lid from claim 9, further comprising a conduit that is connected to said spout.

11. The dispensing paint can lid from claim 9, whereby said slope is at an angle in a range from at about 10 degrees to about 80 degrees from horizontal.

12. The dispensing paint can lid from claim 9, whereby said slope is at an angle less than about 45 degrees from horizontal.

13. The dispensing paint can lid from claim 9, whereby said spout extends exteriorly from a side of said lid for directing the flowable material down said slope through said spout from the side of said lid.

14. The dispensing paint can lid from claim 1, wherein said lid is dimensioned and configured to connect to a paint can having an opening that is substantially a width of said can and a groove about a perimeter of said opening.

* * * * *